United States Patent [19]

Leaf et al.

[11] 4,074,065

[45] Feb. 14, 1978

[54] INSULATED WIRE SPLICE

[75] Inventors: Harry Vincent Leaf, Marshfield; Francis J. Cassidy, Brockton, both of Mass.

[73] Assignee: Ark-Les Switch Corporation, Watertown, Mass.

[21] Appl. No.: 669,155

[22] Filed: Mar. 22, 1976

Related U.S. Application Data

[63] Continuation-in-part of Ser. No. 600,208, July 30, 1975, Pat. No. 3,999,273.

[51] Int. Cl.[2] ..... H01R 5/10

[52] U.S. Cl. ..... 174/87; 29/628; 29/630 A; 174/84 C; 339/276 SF

[58] Field of Search ..... 174/84 C, 87, 90, 94 R; 339/97 C, 223 R, 276 R, 276 SF, 276 T; 29/628, 630 A, 630 F, 751, 753

[56] References Cited

U.S. PATENT DOCUMENTS

| | | | |
|---|---|---|---|
| 3,634,817 | 1/1972 | Wise | 339/223 R X |
| 3,735,331 | 5/1973 | O'Donnell et al. | 339/97 C |
| 4,003,623 | 1/1977 | Reynolds | 339/97 C |

*Primary Examiner*—Laramie E. Askin

[57] ABSTRACT

A post-insulated wire splice includes a conductive connector and an insulating member surrounding the connector. The connector includes a ferrule crimped around at least two wires, the ferrule having a generally smoothly curved exterior surface and having outer and inner ends defined with respect to the wires; the wires extend externally beyond the ferrule inner end and are terminated adjacent the ferrule outer end.

The connector has a separation portion extending beyond the ferrule outer end, including an exterior surface continuous with the ferrule exterior surface and a sheared edge remote from the ferrule. The separation portion is deformed from a shape coincident with a portion of the projection of the ferrule exterior surface to displace the sheared edge inwardly of the projection toward the wires. The insulating member comprises a generally tubular sleeve of insulating plastic material, and in preferred embodiments is crimped and closed around the extending wires beyond the ferrule inner end. The insulating member fits closely around the connector and the connector sheared edge is spaced inwardly from the insulating member.

3 Claims, 9 Drawing Figures

FIG 1
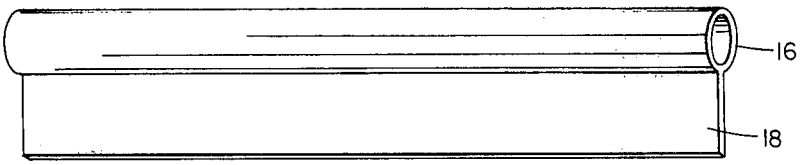
FIG 2
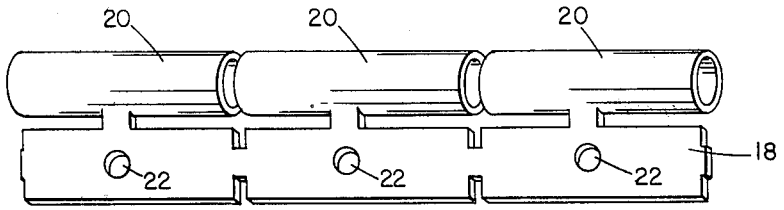
FIG 3
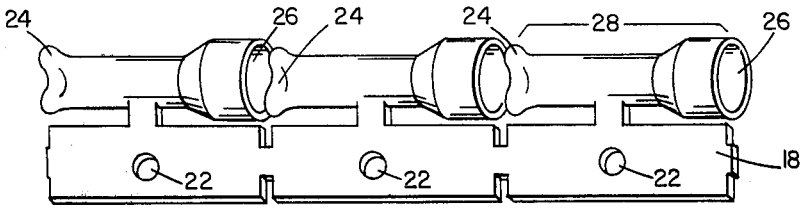
FIG 4
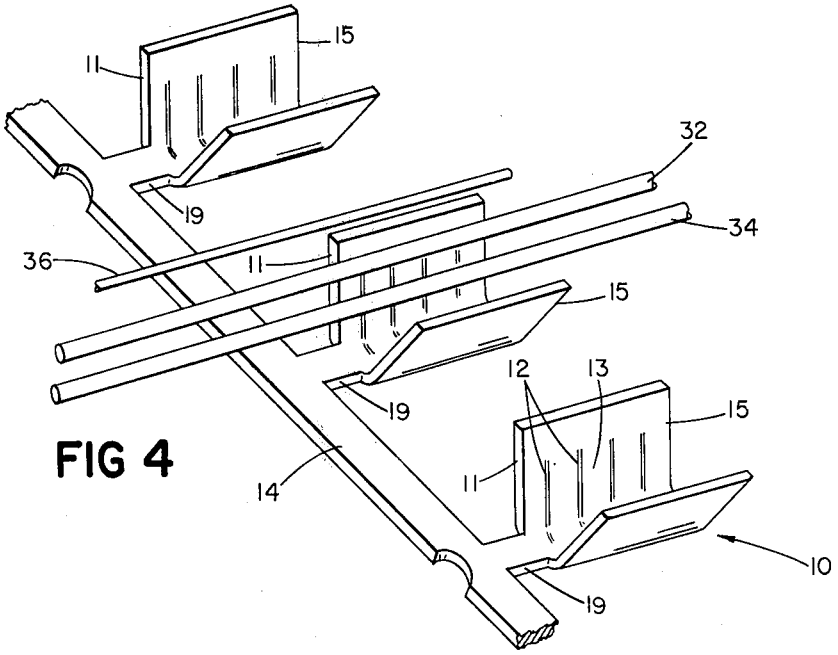
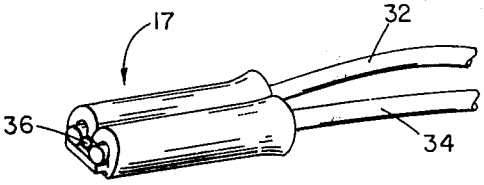
FIG 5
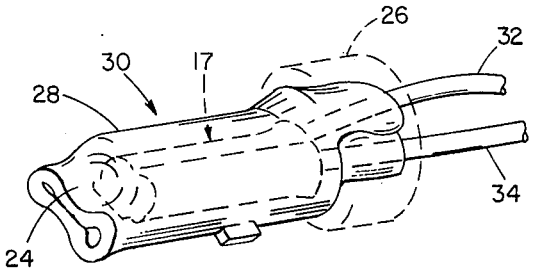
FIG 6

INSULATED WIRE SPLICE

This application is a continuation-in-part of application Ser. No. 600,208, filed July 30, 1975, now U.S. Pat. No. 3,999,273. Its invention relates to post-insulated wire splices, each assembled splice having first a connector crimped around the wires, and next, insulation formed therearound.

Such insulated wire splices are employed, for example, in preparing stators or other similar workpieces having multiple windings. Such a splice must provide a good electrical connection between the spliced wires, and must be completely insulated from other wires. Both the splice and the insulation must be able to withstand motion and flexing incidental to normal use of the workpiece.

Insulated splices have hitherto been difficult and expensive to make and often unsatisfactory in use. Some splices have been assembled by hand by an operator who winds insulating tape around the splice, or slips an insulating sleeve over the splice. A splice insulated with wound tape has been found to be less satisfactory, as gaps or breaks may appear in the wound insulation during the lifetime of the workpiece. Sleeves slid over the splice are often insufficiently securely attached to the splice and may loosen and be lost during later use of the workpiece.

Additionally, splices are formed of metal connectors, which are often supplied on a carrier strip, from which each is severed during the same operation in which the connector is crimped around the wires to be spliced. Such severance frequently results in a connector with a rough or burred edge, which thereafter damages the insulation and ultimately results in the possibility of electrical contact through the resulting break in the insulation. This terminates the useful life of the insulated splice.

In some splices previously used, heat-shrinkable insulating sleeves have been assembled by hand to each splice, and the entire workpiece has then been transferred to an oven for shrinking the sleeves. However, heat-shrinkable sleeves are in general less heat-resistant than sleeves of the kind usable in the splices of the present invention, and splices using heat-shrinkable sleeves have therefore not been entirely satisfactory. Furthermore, such splices require added time to complete, and additional labor as well.

It is therefore an object of this invention to provide a post-insulated wire splice that is easily assembled and is reliable and durable.

it is a further object to provide such a splice that has a good electrical connection through the spliced wires with a closely fitting seamless insulation therearound.

According to the invention, a post-insulated wire splice includes a conductive connector and an insulating member surrounding the connector. The connector includes a ferrule crimped around at least two wires; the ferrule has a generally smoothly curved exterior surface and has outer and inner ends defined with respect to the wires. The wires extend externally beyond the ferrule outer end and are terminated adjacent the ferrule outer end.

The connector has a separation portion extending beyond the ferrule outer end, including an exterior surface continuous with a portion of the ferrule exterior surface and a sheared edge remote from the ferrule. The separation portion is deformed from a shape coincident with a portion of the projection of the ferrule exterior surface to displace the sheared edge inwardly of the projection, toward the wires.

The insulating member comprises a generally tubular sleeve of insulating plastic material, which fits closely around the connector, while the sheared edge is spaced inwardly from the insulating member.

In preferred embodiments, the sleeve is crimped and closed around the extending wires beyond the ferrule inner end and is at least partially closed externally of the ferrule outer end.

Other objects, features and advantages will appear from the following description of a preferred embodiment of the invention, taken together with the attached drawings thereof.

BRIEF DESCRIPTION OF THE DRAWINGS

FIGS. 1 and 2 are views of insulating sleeves suitable for use in making the splice of the invention, at two preliminary stages of their manufacture;

FIG. 3 shows the insulating sleeves in strip form, as supplied to the machine which assembles the splices;

FIG. 4 shows connectors suitable for use in the splices;

FIG. 5 is a view of a completed uninsulated splice;

FIG. 6 is a view of the insulated splice;

DETAILED DESCRIPTION

Figure 7:
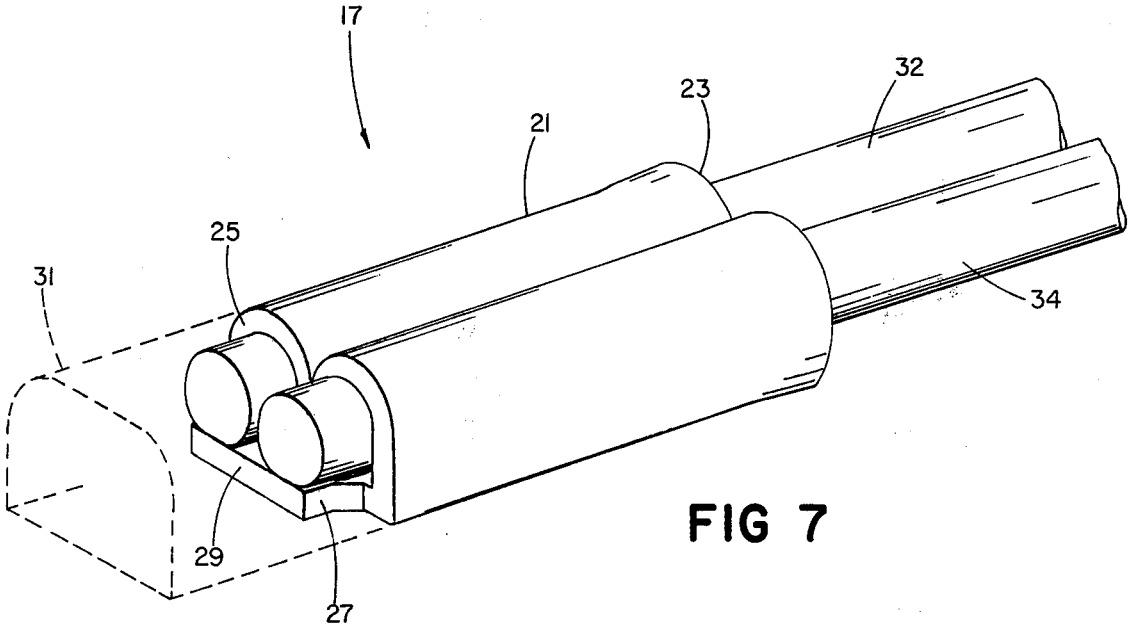
FIG. 7 is a detailed perspective view of the formed splice, uninsulated.

Referring now to the drawings, insulated splices according to the invention are formed by the machine described in U.S. Pat. No. 3,999,273, preferably using metal connectors 10 of the type shown in FIG. 4, which are similar to those more particularly described in U.S. Pat. No. 3,735,331, issued May 22, 1973. Each connector 10 comprises a ferrule-forming portion having its inner surface formed with a plurality of grooves 12 with generally flat land surfaces 13 therebetween, at least some of the grooves having a sharp edged undercut side surface for shearing the wire, to expose the bare metal underlying the insulation coating. Other types of connectors may also be used.

Each connector 10 is attached at one end 11 by a neck 19 to a carrier strip 14, and has a free opposite end 15. Wires to be spliced or connected (comprising in most cases, though not invariably, two insulated magnet wires 32 and 34) are laid into the ferrule-forming portion of the connector over free end 15 together with a filler wire 36 if desired; the connector is then crimped over the wires, as by means described in said U.S. Pat. No. 3,735,331, causing the groove edges to shear portions of the wires and their insulation to form a good electrical connection. At the same time, the connector is severed at end 11 from the carrier strip, and any portions of the wires extending beyond end 11 of the connector in the direction of the carrier strip are also severed. The assembled uninsulated splice 17 is seen in FIG. 5.

Figure 8:
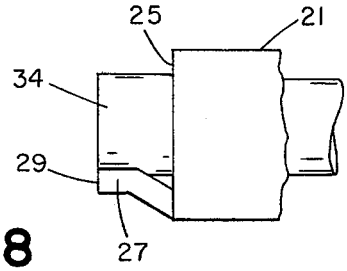
FIGS. 8 and 9 are a side elevation and a plan view seen from below of the deformed separation portion of the splice.
Figure 9:
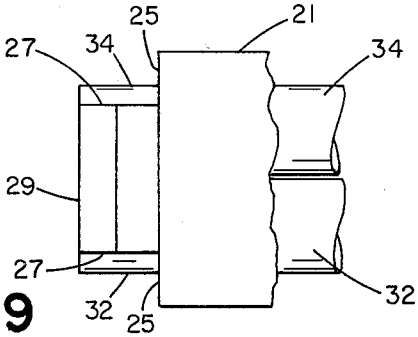

This formed, uninsulated splice 17, as more particularly shown in FIGS. 7–9, includes a ferrule portion 21 which has an inner end 23, beyond which wires 32 and 34 extend, and an outer end 25. The act of severing the connector end 11 from the carrier strip 14 at neck 19 leaves a separation portion 27 extending from the ferrule outer end 25 which separation portion 27 has a sheared edge 29 that may be rough and burred. In order to keep the sheared edge 29 from contacting an insulating member or sleeve which is to be subsequently applied over the splice 17, during the crimping operation the separation portion 27 is deformed upwardly, as seen in FIGS. 7 and 8, out of coincidence with the projected shape 31 of the ferrule. As a result, the sheared edge 29 of separation portion 27 is displaced inwardly toward the wire ends. Consequently, when insulation sleeve 28 (see FIG. 6) is placed around the formed splice 17, the sheared edge 29 is removed from contact therewith. Without such deformation of the separation portion 27 of the connector, the sheared edge 29 would rub against the insulation sleeve 28 and ultimately wear through it, thereby producing the possibility of electrical contact with the splice through the pierced insulation.

Insulators suitable for use in forming the splices of the invention are preferably initially formed as an extruded seamless tube 16 of suitable high temperature heat stabilized plastic material with an integral attached web 18 (FIG. 1). Individual unformed sleeves 20 are blanked out (FIG. 2) and feed holes 22 are provided in web 18 in the same operation. In a further operation, one end of each sleeve is heat-sealed in a D-form seal as at 24, while the other end is expanded to form a bell mouth 26, providing a formed sleeve 28 (FIG. 3). The strip of formed insulating sleeves may then be coiled and supplied to the machine.

By means described in U.S. Pat. No. 3,999,273, formed insulating sleeve 28 is placed over the crimped splice, the expanded bell mouth 26 acting to guide the splice into the sleeve, and the D-seal acting as a stop positively to position the splice within sleeve 28. Heat and pressure are then applied to crimp and close the end 26 of the sleeve over the wires beyond the splice, forming an insulated splice 30 (FIG. 6) having the insulation closely and accurately fitting the splice.

What is claimed is:

1. A post-insulated wire splice including a conductive connector and an insulating member surrounding said connector, said connector including a ferrule crimped around at least two wires, said ferrule having a generally smoothly curvd exterior surface and having outer and inner ends defined with respect to said wires, said wires extending externally beyond said ferrule inner end and being terminated adjacent said ferrule outer end, said connector having a separation portion extending beyond said ferrule outer end, including an exterior surface continuous with a portion of said ferrule exterior surface and a sheared edge remote from said ferrule, said separation portion being deformed from a shape coincident with a portion of the projection of said ferrule exterior surface to displace said sheared edge inwardly of said projection of said ferrule exterior surface toward said wires, said insulating member comprising a generally tubular sleeve of insulating plastic material, said insulating member fitting closely around said connector, and said connector sheared edge being spaced inwardly from said insulating member.

2. The splice of claim 1, wherein said insulating tubular sleeve is crimped and closed around said extending wires beyond said ferrule inner end.

3. The wire splice of claim 1 wherein said sleeve is at least partially closed externally of said ferrule outer end.

* * * * *